US009896115B2

(12) United States Patent
Wills et al.

(10) Patent No.: US 9,896,115 B2
(45) Date of Patent: Feb. 20, 2018

(54) SYSTEM AND METHOD FOR COORDINATING TERMINAL OPERATIONS WITH LINE OF ROAD MOVEMENTS

(71) Applicant: GENERAL ELECTRIC COMPANY, Schenectady, NY (US)

(72) Inventors: Mitchell Scott Wills, Melbourne, FL (US); Mahir Erdem Telatar, Melbourne, FL (US); Jian Li, Melbourne, FL (US); Trevor Fletcher, Melbourne, FL (US); David Peltz, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/192,202

(22) Filed: Jun. 24, 2016

(65) Prior Publication Data

US 2016/0375918 A1 Dec. 29, 2016

Related U.S. Application Data

(60) Provisional application No. 62/185,587, filed on Jun. 27, 2015.

(51) Int. Cl.
*B61L 27/00* (2006.01)
*B61L 17/02* (2006.01)

(52) U.S. Cl.
CPC ..... *B61L 27/0016* (2013.01); *B61L 17/02* (2013.01); *B61L 27/0077* (2013.01); *B61L 27/0005* (2013.01)

(58) Field of Classification Search
CPC ..... B61L 27/0016; B61L 27/0077; B61L 27/0005; B61L 17/02
See application file for complete search history.

(56) References Cited

U.S. PATENT DOCUMENTS 5,623,413 A * 4/1997 Matheson ..... B61L 27/0016 104/307
6,377,877 B1 4/2002 Doner et al.
(Continued)

OTHER PUBLICATIONS

Kaffka et al., Revealing gaps in the material flow of inland port container terminals alongside the Danube with simulation, 2014, p. 1807-1818.*

(Continued)

*Primary Examiner* — McDieunel Marc
(74) *Attorney, Agent, or Firm* — GE Global Patent Operation; John A. Kramer

(57) ABSTRACT

A terminal operating system includes one or more processors configured to obtain one or more parameters of non-propulsion-generating cargo vehicles and to determine which of the non-propulsion-generating cargo vehicles are to be included in a vehicle system assembled in a terminal or yard based on the one or more parameters. The one or more parameters include one or more of an earliest time of availability at which cargo equipment will be available in the terminal or yard, a safety operational characteristic, an efficiency operational characteristic of the one or more non-propulsion-generating cargo vehicles, and/or a priority parameter of the one or more non-propulsion-generating cargo vehicles. The one or more processors are configured to automatically direct equipment within the terminal or yard to assemble the vehicle system based on the one or more parameters.

21 Claims, 5 Drawing Sheets

(56) References Cited

U.S. PATENT DOCUMENTS 6,832,204 B1 12/2004 Doner et al.
6,961,682 B2 11/2005 Doner et al.
7,770,847 B1 * 8/2010 Severson ..... A63H 19/24 246/1 C
8,154,227 B1 * 4/2012 Young ..... A63H 19/24 318/255
2004/0006413 A1 * 1/2004 Kane ..... B61L 3/008 701/19
2004/0010432 A1 * 1/2004 Matheson ..... B61L 27/0016 705/7.22
2004/0034556 A1 * 2/2004 Matheson ..... B61L 27/0016 705/7.24
2006/0005739 A1 * 1/2006 Kumar ..... B60L 7/06 105/35
2006/0212184 A1 * 9/2006 Philp ..... B61L 27/0011 701/19
2007/0005200 A1 * 1/2007 Wills ..... B61L 17/00 701/19
2007/0225878 A1 * 9/2007 Kumar ..... B61L 3/006 701/19
2007/0299570 A1 * 12/2007 Muinonen ..... B61L 17/00 701/19
2008/0119973 A1 * 5/2008 Pathak ..... B61L 17/02 701/19
2008/0154692 A1 * 6/2008 Logan ..... B61L 17/00 701/19
2013/0144670 A1 * 6/2013 Kickbusch ..... G06Q 10/06 705/7.12
2013/0268147 A1 * 10/2013 Chundru ..... B61C 17/12 701/19

OTHER PUBLICATIONS

Liu et al., Comparing different technologies for containers movement in marine container terminals , 2000, IEEE, p. 488-493.*

* cited by examiner

SYSTEM AND METHOD FOR COORDINATING TERMINAL OPERATIONS WITH LINE OF ROAD MOVEMENTS

CROSS-REFERENCE TO RELATED APPLICATIONS

This application claims priority to U.S. Provisional Application No. 62/185,587, which was filed on 27 Jun. 2015, and the entire disclosure of which is incorporated herein by reference.

FIELD

Embodiments of the subject matter disclosed herein relate to coordinating movements of one or more vehicle systems into and/or out of vehicle yards and along routes that connect the vehicle yards.

BACKGROUND

Transportation networks formed from many interconnected routes may be concurrently traveled by several different vehicles, such as trains traveling along interconnected tracks. The transportation networks can include terminals and/or rail yards where trains are taken apart into locomotives and rail cars; maintenance, repair, and/or inspection is performed on the locomotives and/or rail cars; locomotives and/or rail cars of various types, capabilities, and operating characteristics are combined into trains for departure; etc. Some terminals and/or rail yards operate according to terminal plans dictated by terminal operating systems. These terminal operating systems can design the plans to designate which operations are performed on the trains, locomotives, and rail cars in order to process the movement of the locomotives and rail cars into, through, and out of the rail yards and/or the terminals.

Once a train leaves a terminal and/or rail yard, the train travels along one or more tracks that are outside of, but connect, the different rail yards in the transportation network. These travels may be referred to as line of road movements. The line of road movements may be dictated by schedules determined by a line of road planning or dispatch system. These schedules also can be referred to as line of road plans. The dispatch system can determine the schedules and train make-ups in order to ensure the safe, timely, and cost effective travel of the different trains in the transportation network between the rail yards based on host of variables such as track or train speed restrictions, grades, curves, and the operating characteristics of the vehicles.

Currently, each of these different planning domains (e.g., terminal plans and line of road schedules) generates the respective plans without sharing information between the different domains. Little information is available to a line of road dispatch system concerning building of trains emerging from rail yards, and the availability of resources in the rail yard to process trains approaching the yards is not available to the dispatch system. Likewise, there is no real-time data feed provided to the terminal operating systems describing the planned approach of trains heading toward rail yards, and there is no communication of an ability of the tracks outside of the vehicle yards to accept emerging outbound trains from a yard or terminal.

BRIEF DESCRIPTION

In one embodiment, a composite system includes a road dispatch system and a terminal operating system that coordinate vehicle operations across and/or beyond a planning boundary between the road dispatch system and the terminal operating system to provide more efficient and cost effective operation than either the road dispatch system or the terminal operating system functioning alone.

In one embodiment, a method (e.g., for coordinating terminal operations with line of road movements) includes obtaining (at a road dispatch system that schedules movements of vehicle systems in a transportation network) travel parameters related to the movements of vehicle systems on routes that are outside of vehicle yards and terminals in the transportation network, obtaining (at a terminal operating system that plans yard operations within vehicle yards and terminals) yard parameters related to the yard operations performed in the vehicle yards and terminals, communicating the travel parameters from the road dispatch system to the terminal operating system, communicating the yard parameters from the terminal operating system to the road dispatch system, and scheduling and configuring network operations within the transportation network based on the travel parameters and the yard parameters. The network operations that are scheduled include the movements of the vehicle systems on the routes outside of the vehicle yards and the terminals based on the yard parameters and the yard operations to be performed on the vehicle systems in the vehicle yards and the terminals.

In one embodiment, a system (e.g., a composite system for coordinating terminal operations with line of road movements) includes one or more first processors configured to obtain (at a road dispatch system that schedules movements of vehicle systems in a transportation network) travel parameters related to the movements of vehicle systems on routes that are outside of vehicle yards and terminals in the transportation network, one or more second processors configured to obtain (at a terminal operating system that plans yard operations within vehicle yards and terminals) yard parameters related to the yard operations performed in the vehicle yards and terminals, a first communication unit configured to communicate the travel parameters from the road dispatch system to the terminal operating system, and a second communication unit configured to communicate the yard parameters from the terminal operating system to the road dispatch system. The one or more first processors are configured to schedule and configure the movements of the vehicle systems on the routes outside of the vehicle yards and the terminals based on the yard parameters and the one or more second processors are configured to schedule the yard operations to be performed on the vehicle systems in the vehicle yards and the terminals based on the travel parameters.

In one embodiment, a terminal operating system includes one or more processors configured to obtain one or more parameters of non-propulsion-generating cargo vehicles and to determine which of the non-propulsion-generating cargo vehicles are to be included in a vehicle system assembled in a terminal or yard based on the one or more parameters. The one or more parameters include one or more of an earliest time of availability at which cargo equipment will be available in the terminal or yard, a safety operational characteristic, an efficiency operational characteristic of the one or more non-propulsion-generating cargo vehicles, and/or a priority parameter of the one or more non-propulsion-generating cargo vehicles. The one or more processors are configured to automatically direct equipment within the terminal or yard to assemble the vehicle system based on the one or more parameters.

In one embodiment, a method includes obtaining, at a terminal operating system of a terminal or yard, one or more parameters of non-propulsion-generating cargo vehicles, and selecting the non-propulsion-generating cargo vehicles that are to be included in a vehicle system assembled in the terminal or yard based on the one or more parameters. The one or more parameters include one or more of an earliest time of availability at which cargo equipment will be available in the terminal or yard, a safety operational characteristic, an efficiency operational characteristic of the one or more non-propulsion-generating cargo vehicles, and/or a priority parameter of the one or more non-propulsion-generating cargo vehicles. The method also includes assembling the vehicle system with the non-propulsion-generating cargo vehicles that are selected for inclusion in the vehicle system.

In one embodiment, a system includes one or more first processors configured to obtain, at a road dispatch system that schedules movements of vehicle systems in a transportation network, travel parameters related to the movements of vehicle systems on routes that are outside of vehicle yards and terminals in the transportation network. The system also includes one or more second processors configured to obtain, at a terminal operating system that plans yard operations within vehicle yards and terminals, yard parameters related to the yard operations performed in the vehicle yards and terminals. The system also includes a first communication unit configured to communicate the travel parameters from the road dispatch system to the terminal operating system and a second communication unit configured to communicate the yard parameters from the terminal operating system to the road dispatch system. The one or more first processors are configured to schedule the movements of the vehicle systems on the routes outside of the vehicle yards and the terminals based on the yard parameters and the one or more second processors are configured to schedule the yard operations to be performed on the vehicle systems in the vehicle yards and the terminals based on the travel parameters.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Embodiments of the inventive subject matter described herein relate to methods and systems for coordinating the planning activities for vehicle yards with the movement schedules for, and arrangement of vehicles moving between the vehicle yards. A terminal operating system can plan the activities to be performed within a terminal or a vehicle yard, a rail yard, a location where a trip of a vehicle system begins or ends, or the like. A line of road dispatch system can plan the movements of vehicle systems between the vehicle yards. These systems can coordinate the plans for within the vehicle yards and for travel between the vehicle yards by exchanging parameters and routes of vehicle systems approaching a terminal or vehicle yard, and vehicle systems emerging from a terminal or vehicle yard. The plans formed by the systems conform to constraints derived from the exchanged parameters, and the plans can be automatically executed by other systems, such as a movement planning system and/or a yard planning system. The coordination of these plans can improve connection performance of the vehicle systems, decrease dwell time of one or more vehicle units in the vehicle systems within the yards, increased on-time performance of the vehicle systems, increased network velocity, and the like.

Figure 1:
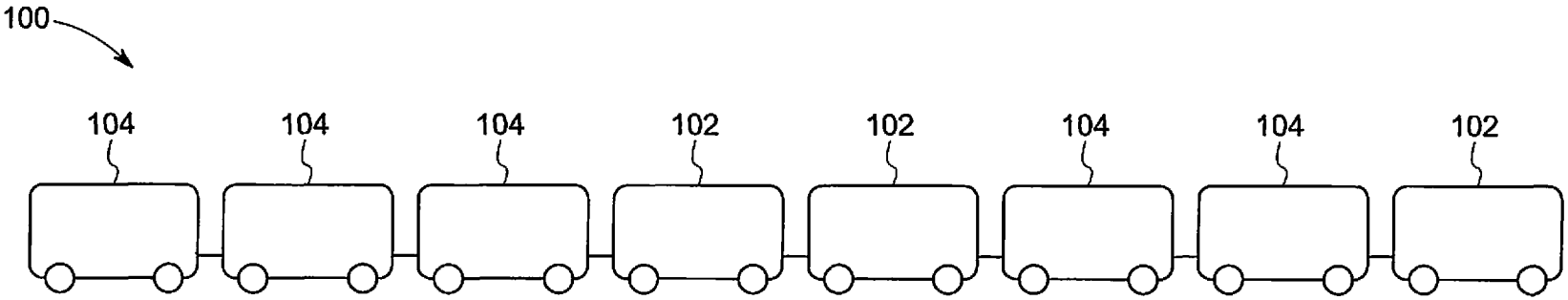
FIG. 1 illustrates one example of a vehicle system.

FIG. 1 illustrates one example of a vehicle system 100. The vehicle system 100 includes several vehicle units 102, 104 that travel together along a route. The vehicle units 102, 104 are shown as being mechanically coupled with each other, but optionally may not be connected with each other. For example, the vehicle units 102, 104 may not all be connected together such that two or more vehicle units 102, 104 are separate but communicate with each other to coordinate their respective movements such that the separate vehicle units 102, 104 travel together along a route. The vehicle units 102 can represent propulsion-generating vehicles, such as locomotives, automobiles, marine vessels, mining vehicles, or the like. The vehicle units 104 can represent non-propulsion-generating vehicles, such as railcars, trailers, barges, or the like. Each of the vehicle units 102 and 104 may have unique operating characteristics that will affect how the vehicles 102, 104 operate with each other and with the routes that the vehicles 102, 104 follow. While the description focuses on rail vehicles, not all embodiments of the inventive subject matter described herein is limited to rail vehicles.

Figure 2:
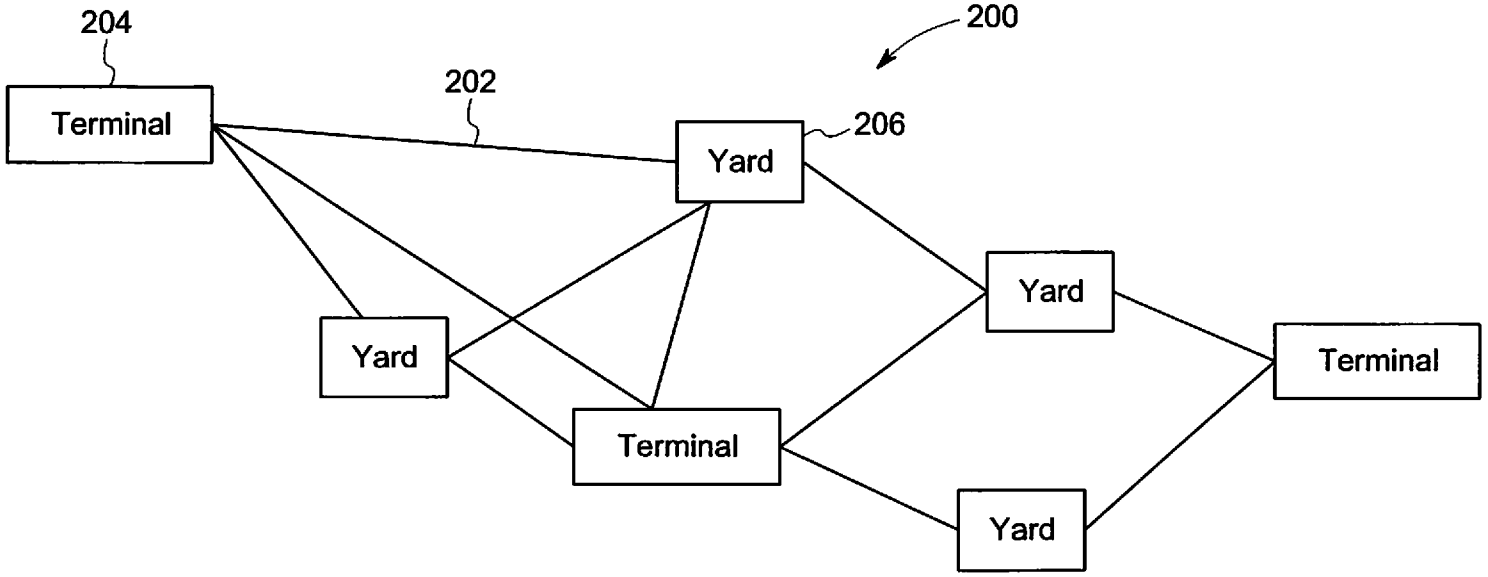
FIG. 2 illustrates one example of a transportation network.

FIG. 2 illustrates one example of a transportation network 200. The transportation network 200 is formed from interconnected routes 202, which can represent rail tracks, roads, trails, tunnels, waterways, or the like. The routes 202 may be referred to as over the road routes as these routes 202 extend between terminals 204 ("Terminal" in FIG. 2) and vehicle yards 206 ("Yard" in FIG. 2). The terminals 204 can represent locations where cargo and/or crews may be loaded onto and/or unloaded from the vehicle systems 100, such as a train station, or port, an origin location for a trip, or the like. The vehicle yards 206 can represent locations where various processing activities are performed on the vehicle systems 100 and/or the vehicle units 102, 104, such as combining two or more vehicle units 102, 104 to form a vehicle system 100 that leaves the vehicle yard 206, receiving a vehicle system 100 and separating the vehicle system 100 into the separate vehicle units 102, 104 that form the vehicle system 100, repairing vehicle units 102, 104, inspecting vehicle units 102, 104, identifying vehicles 102, 104, to obtain their individual operating characteristics, loading cargo onto and/or unloading cargo from the vehicle units 102, fueling, and replenishing other consumables when 104 is a propulsion-generating vehicle, etc. Vehicle yards 206 may include several different routes within the yards 206 that are relatively close to each other for organizing the vehicle units 102, 104 and for assembling vehicle systems 100. These routes in the vehicle yards 206 may not extend to other vehicle yards 206 or terminals 204. Terminals 204, on the other hand, do not include such routes within the terminals 204 that are close to each other.

During a trip of one or more vehicle units 102, 104 in the transportation network 200, a vehicle system 100 that is formed from the vehicle units 102, 104 may depart from one terminal 204 with a first set of vehicle units 102, 104. The vehicle system 100 can travel to a first vehicle yard 206 where the vehicle system 100 is taken apart and the vehicle units 102, 104 separated from each other. These vehicle units 102, 104 may be combined with other vehicle units 102, 104 in two or more other vehicle systems 100 that depart the first vehicle yard 206 for travel to another terminal 204 or vehicle yard 206. At the terminals 204 and/or vehicle yards 206, cargo can be loaded and/or unloaded, vehicle units 102, 104 can be removed and/or added, and the like. The vehicle units 102, 104 can switch between different vehicle systems 100 as the various vehicle units 102, 104 make their way through the transportation network 200 until the various vehicle units 102, 104 reach the final destination locations (e.g., terminals 204) of the vehicle units 102, 104.

Figure 3:
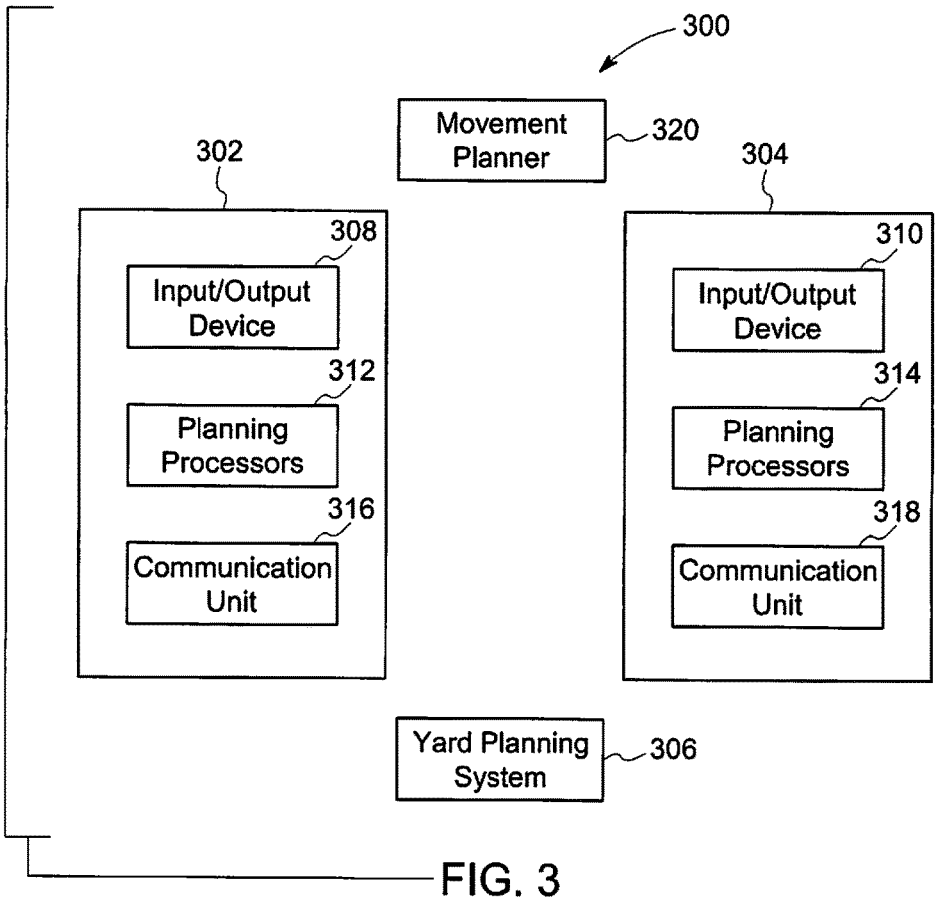
FIG. 3 illustrates a composite coordination system according to one embodiment.

FIG. 3 illustrates a composite coordination system 300 according to one embodiment. The system 300 coordinates planning operations of a terminal operating system 302 and a road dispatch system 304 by exchanging parameters and routes of vehicle systems 100 approaching terminals 204 and/or vehicle yards 206, and of vehicle systems 100 emerging from terminals 204 and/or vehicle yards 206. The parameters communicated from the terminal operating system 302 to the road dispatch system 304 can be referred to as yard parameters and the parameters communicated from the road dispatch system 304 to the terminal operating system 302 can be referred to as travel parameters.

The terminal operating system 302 generates one or more plans for assembling a vehicle system 100, and/or scheduling operations to be performed within one or more of the terminals 204 and/or vehicle yards 206 (referred to herein as "yard plans") based on the exchanged parameters and routes. The road dispatch system 304 generates one or more plans for scheduling movements of the vehicle systems 100 over the routes 202 between the vehicle yards 206 and/or terminals 204 based on the exchanged parameters (referred to herein as "movement plans"). Portions of the movement plan can be communicated to the vehicle systems 100 and/or other systems to control movements of the vehicle systems 100 on the routes 202. A yard planning system 306 can obtain the yard plan for one or more terminals 204 and/or vehicle yards 206. The yard planning system 306 can implement the yard plan by automatically directing various equipment located within the terminal 204 and/or vehicle yard 206 to perform the operations scheduled by the yard plan in accordance with the yard plan. This equipment can include cranes that load or unload cargo, propulsion-generating vehicles within the yard to move the non-propulsion-generating vehicles within the yard to assemble vehicle systems, robotic systems that automatically bleed brake levers, etc.

The parameters communicated from the terminal operating system 302 to the road dispatch system 304 can be used as constraints or priorities on the movement plans determined by the road dispatch system 304. For example, the parameters from the terminal operating system 302 can limit or restrict how the movements of the vehicle systems 100 between the terminals 204 and/or vehicle yards 206 occur. Alternatively, the parameters from the terminal operating system 302 can prioritize the movements of the vehicle systems 100 between the terminals 204 and/or vehicle yards 206. Similarly, the parameters communicated from the road dispatch system 304 to the terminal operating system 302 can be used as constraints or priorities on the yard plans determined by the terminal operating system 302. For example, the parameters from the road dispatch system 304 can limit or restrict the number and weight of the vehicles 102 and 104 that are being assembled into the vehicle system 100 within a vehicle yard 206.

The terminal operating system 302 and the road dispatch system 304 can separately plan operations within logical planning boundaries associated with the different systems 302, 304. A logical boundary represents a list or group of operations that may be planned by a system 302 or 304, while operations that are not in the list or group are outside of the boundary for that system 302 or 304 and, as a result, are not planned for by the system 302 or 304. The system 300 shown in FIG. 3 coordinates communications between the terminal operating system 302 and the road dispatch system 304 to provide for planning across the boundaries of the systems 302, 304 to provide for more efficient operations and movements of the vehicle systems 100 compared to either the terminal operating system 302 or the road dispatch system 304 operating alone (e.g., without receiving the parameters communicated from the other system 302 or 304).

The planning boundary for the road dispatch system 304 can include scheduling movements for, and arrangements of the vehicle systems 100 to provide for safe and efficient conveyance of the vehicle systems 100 across and/or beyond the transportation network 200, which can include many terminals 204, switching yards, and different types of industry (e.g., shippers and receivers of cargo). The planning boundary for the terminal operating system 302 can include scheduling and/or arrangement operations performed inside terminals 204 and/or vehicle yards 206 (and outside of the routes 202) to provide for safe and efficient switching of vehicle units 102, 104 received and delivered to and from industry, and to and from line-of-road routes 202.

Figure 4:
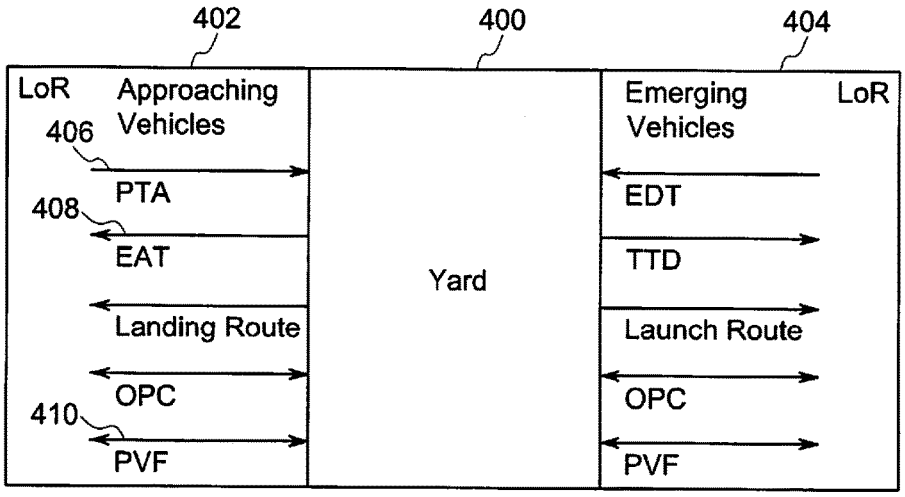
FIG. 4 illustrates communication of parameters between a terminal operating system shown in FIG. 3 and a road dispatch system shown in FIG. 3 according to one embodiment.

FIG. 4 illustrates communication of parameters between the terminal operating system 302 and the road dispatch system 304 according to one embodiment. A yard 400 represents parameters communicated to and/or from a vehicle yard 206 or terminal 204, an "Approaching Trains" line of road (LoR) routes 402 represents parameters communicated to and/or from the road dispatch system 304 concerning vehicle systems 100 that are traveling toward vehicle yards 206 and/or terminals 204, and an "Emerging Trains" LoR routes 404 represents parameters communicated to and/or from the road dispatch system 304 concerning vehicle systems 100 that are traveling out of vehicle yards 206 and/or terminals 204.

Several arrows 406, 408, 410 represent the direction of communication of various parameters. For example, the arrow 406 pointing toward the yard 400 and associated with a parameter indicates that information about the parameter is communicated from the road dispatch system 304 to the terminal operating system 302. As another example, the arrow 408 pointing toward the LoR routes 402 and associated with a parameter indicates that information about that parameter is communicated from the terminal operating system 302 to the road dispatch system 304. The double-sided arrows 410 indicate parameters communicated to and/or from the terminal operating system 302 with the road dispatch system 304. Depending on whether the parameter is located in the Approaching Trains LoR routes 402 or the Emerging Trains LoR routes 404 indicates if the parameter includes information about vehicle systems 100 heading into or out of a vehicle yard 206 and/or terminal 204.

A "PTA" parameter can be communicated from the road dispatch system 304 to the terminal operating system 302. This parameter can represent planned or scheduled times of arrival of the vehicle systems 100 at the corresponding vehicle yards 206 and/or terminals 204. The road dispatch system 304 can determine the PTA parameter (e.g., Planned Time of Arrival) from previously generated schedules of vehicle systems 100, current locations of the vehicle systems 100, moving speeds of the vehicle systems 100, speed limits of the routes 202, anticipated meets and passes, planned activities, anticipated delays and the like.

An "EAT" parameter can be communicated from the terminal operating system 302 to the road dispatch system 304. This parameter can represent Earliest Arrival Time of the vehicle systems 100 traveling toward the vehicle yards 206 and/or terminals 204. For example, this parameter can indicate the earliest time at which the vehicle yard 206 and/or terminal 204 will have the resources (e.g., space, equipment, etc.) for receiving the vehicle system 100. Arrival of a vehicle system 100 prior to this time may result in the vehicle system 100 having to sit outside of the vehicle yard 206 and/or terminal 204 until the vehicle yard 206 and/or terminal 204 is able to receive the vehicle system 100. The terminal operating system 302 can determine this parameter from the previously scheduled operations to be performed on the vehicle systems 100, the current status of those operations, the availability of manpower and equipment to perform the operations, and the like. In one example, the EAT parameter can be determined based on an availability of resources or equipment within the yard and used to process the approaching vehicle system 100 within the vehicle yard 206 or terminal 204, such as when a receiving track in the yard 206 will be available, when a yard crew of workers will be available, and when yard vehicles (e.g., yard locomotives), road crew, and road power for the outbound vehicle system 100 that will carry the vehicle units 104 from the approaching vehicle system 100 will be available, when cargo loading or unloading equipment (e.g., cranes) will be available, etc.

A "Landing Track" parameter can be communicated from the terminal operating system 302 to the road dispatch system 304. This parameter can represent which ingress route inside a vehicle yard 206 or terminal 204 that a vehicle system 100 is to enter the vehicle yard 206 or terminal 204 on. The vehicle yard 206 or terminal 204 may have different routes of entry into the vehicle yard 206 or terminal 204, and the availability of these entry routes may change with respect to time. The Landing Track parameter can restrict where the vehicle systems 100 ingress into the vehicle yards 206 and/or terminals 204. The terminal operating system 302 can determine this parameter from previously scheduled arrivals of other vehicle systems 100, current and expected occupancies of routes within the yard 206 and/or terminal 204, or the like. In one example, the Landing Track parameter is determined based on a receiving route within the vehicle yard 206 on which the incoming vehicle system 100 will be yarded (e.g., at least temporarily stored), the route 202 over which the vehicle system 100 will travel from a previous (e.g., intermediate or point-of-origin) terminal 204 or switching facility, and planned activities (e.g., train, car, maintenance of way, or inspection activities) on routes in the vehicle yard 206 that are adjacent to or between the ingress route and a current location of the vehicle system 100.

An "EDT" parameter can be communicated from the road dispatch system 304 to the terminal operating system 302. This parameter can represent an Earliest Departure Time that a vehicle system 100 can leave a vehicle yard 206 and/or terminal 204. Certain routes 202 connected to vehicle yards 206 and/or terminals 204 may be occupied by other vehicle systems 100 at different times. The road dispatch system 304 can determine this parameter from previously generated schedules of vehicle systems 100, current locations of the vehicle systems 100, moving speeds of the vehicle systems 100, speed limits of the routes 202, and the like. This parameter can be communicated to the terminal operating system 302 that that the system 302 is aware of when different vehicle systems 100 can leave the vehicle yards 206 and/or terminals 204.

A "TTD" parameter can be communicated from the terminal operating system 302 to the road dispatch system 304. This parameter can represent a Target Time of Departure for a vehicle system 100 to leave a vehicle yard 206 and/or terminal 204. The target time of departure can be based on how many operations need to be performed on the vehicle system 100, the availability of equipment and manpower to perform the operations, etc. This parameter can be communicated so that the road dispatch system 304 can be aware of when the vehicle system 100 may be leaving the vehicle yard 206 and/or terminal 204, and entering one or more routes 202. The terminal operating system 302 can determine the TTD parameter from the previously scheduled operations to be performed on the vehicle systems 100, the current status of those operations, the availability of manpower and equipment to perform the operations, and the like. This parameter can be determined by an operating plan (e.g., schedule) of other vehicle systems 100 moving in the transportation network 200, the planned completion of building operations for one or more vehicle systems 100 within a vehicle yard 206, and/or the availability of resources used to build the outbound vehicle system 100, including forwarding track availability, availability of a yard crew and yard vehicles (e.g., yard locomotives), road crew and road power for the outbound vehicle system 100.

A "Launch Track" parameter can be communicated from the terminal operating system 302 to the road dispatch system 304. This parameter can represent an egress route of the yard 206 or terminal 204 on which a vehicle system 100 will be leaving the vehicle yard 206 or terminal 204 on. The vehicle yard 206 or terminal 204 may have different routes of exit, and the availability of these exit routes may change with respect to time. The Launch Track parameter can restrict where the vehicle systems 100 egress from the vehicle yards 206 and/or terminals 204. The terminal operating system 302 can determine this parameter from operations to be performed on the vehicle systems 100 are scheduled to be performed within the yard 206 or terminal 204, the current status of those operations, the availability of routes that exit from the year 206 and/or terminal 204, and the like. In one example, the terminal operating system 302 determines the Launch Track parameter based on a forwarding track within the vehicle yard 206 on which a vehicle system 100 is being build or will be built, the route 202 over which the vehicle system 100 will travel to its next (e.g., intermediate or final) destination, and activities (e.g., train, car, maintenance of way, or inspection activities) planned or scheduled on the routes within the yard 206 that are adjacent to or between a current location of the vehicle system 100 and the egress route.

An OPC parameter can be communicated between the terminal operating system 302 to the road dispatch system 304. This parameter can represent a host of OPerating Characteristics of vehicles 102 and 104 which will influence where in the vehicle system 100 should specific vehicles 102 and 104 be located during the assembly process, and which vehicles 102 and 104 should be assembled in a vehicle system 100. Some OPC parameters can relate to safety. In one example for rail-based and road-based vehicle systems 100, very light weight vehicles 104 should not be assembled near heavy vehicles 104, nor near propulsive vehicles 102, as high local compressive forces can "squeeze" the light weight vehicle 104 off the rail causing a derailment, or "jack-knife" off the road causing a wreck. In another example for rail-based vehicle systems 100, the amount of free slack in the individual vehicle coupling systems will dictate whether multiple propulsive vehicles 102 can be assembled at the front of the train for ease of assembly, or should be dispersed through the train to counter adverse "slack-action" and travelling waves of force.

Other OPC's can relate to efficiency. One example of using an OPC for efficiency is grouping double-stack shipping container vehicles 104 together and separate from single-stack shipping container vehicles 104 to minimize or reduce air turbulence and wind resistance (e.g., relative to placing these vehicles next to each other along the length of the vehicle system). A double-stack shipping container vehicle 104 may be a vehicle having two (or more) containers (e.g., intermodal containers) vertically stacked on each other, whereas a single stack shipping container vehicle 104 may not have any containers stacked on top of each other.

Another example of using OPC for efficiency is to determine the proper amount of motive power required for a given assembly of vehicles 102, and select the best suited available propulsive vehicles 104. Enough motive power is required to pull the vehicles system 100 over the ruling grade of the route 202, but over-powering may be a waste of motive power that be put to better use on a different vehicle system.

A PVF parameter can be communicated between the terminal operating system 302 to the road dispatch system 304. This parameter can represent a Priority/Value Factor which will influence which vehicles 104 are placed in an earlier departing vehicle system 100, or perhaps in a special high-speed vehicle system 100, or be routed along the shortest route 202 between terminals, and/or be routed along a route that includes fewer stops (relative to another route) to a final destination. Priority generally refers to the time criticality of the commodity being shipped, such as "just-in-time" parts delivery, or "overnight" parcel delivery, where shippers may negotiate incentives or fines for time of delivery. Value generally refers to the profit made by the shipper from the commodity being delivered.

Returning to the description of the system 300 shown in FIG. 3, each of the terminal operating system 302 and the road dispatch system 304 includes an input/output device 308, 310. The devices 308, 310 can represent one or more devices that receive information from an operator of the system 304, 306, such as keyboards, an electronic mouse, touchscreens, styluses, microphones, or the like. This information can be used to determine the parameters described herein. The devices 308, 310 can include one or more devices that provide information to the operators, such as computer monitors, touchscreens, speakers, or the like. This information can include the parameters.

The terminal operating system 302 and the road dispatch system 304 can include hardware circuitry that includes and/or is connected with one or more processors 312, 314 ("Planning Processors" in FIG. 3). The processors 312, 314 can receive the parameters communicated from the other system 302, 304 and determine how to plan movements of the vehicle systems 100 and/or operations within the terminals 204 and/or vehicle yards 206 within constraints of the communicated parameters. For example, the processors 312 in the terminal operating system 302 can examine the PTA parameter to determine when various vehicle systems 100 are arriving at one or more vehicle yards 206 and/or terminals 204 and the EDT parameter to determine when vehicle systems 100 being built and/or located in vehicle yards 206 and/or terminals 204 can leave the vehicle yards 206 and/or terminals 204. Additionally, the processor 312 in the terminal operating system 302 can examine the OPC and PVF parameters to determine which propulsion-generating vehicles 102 and non-propulsive vehicles 104 are best to be assembled into vehicle system 100. Based on these parameters, the processors 312 can determine what operations can be performed on the vehicle systems 100 in the vehicle yards 206 and/or terminals 204, how much time is available to perform the operations, how many resources are needed and/or available for performing the operations, or the like. The processors 312 can then generate a list, table, or other memory structure indicating the operations that can be performed on the vehicle systems 100 in the vehicle yards 206 and/or terminals 204, when the operations need to be completed, what resources are to be reserved for performing the operations, when vehicle systems 100 are permitted to leave the vehicle yards 206 and/or terminals 204, etc. In one example, the processors 312 can plans arrivals and departures of vehicle systems 100 into and out of vehicle yards 206 and/or terminals 204 so as to comply with the PTA parameter and EDT parameter specified by the road dispatch system 304 and at the same time, maximize or increase the safety, efficiency, and cost effectiveness of the assembled vehicle based on the PVF and OPC parameters for each vehicle system 100 emerging from the vehicle yard 206 or terminal 204.

The processors 314 in the road dispatch system 304 can examine the EAT parameter to determine how soon one or more vehicle systems 100 can enter into the yards 206 and/or terminals 204, the Landing Track parameter to determine where the vehicle systems 100 can enter into the yards 206 and/or terminals 204, the TTD parameter to determine when the vehicle systems 100 will be leaving the yards 206 and/or terminals 204, and/or the Launch Track parameter to determine where the vehicle systems 100 will be leaving the yards 206 and/or terminals 204. Based on this information and the capacity of the routes 202 to handle the vehicle systems 100 at different times, the road dispatch system 304 can determine restrictions on when and where the vehicle systems 100 can travel. For example, the processors 314 may prohibit vehicle systems 100 from entering a vehicle yard 206 prior to a time dictated by the EAT parameter, may prohibit vehicle systems 100 from traveling on routes 202 that do not provide access to the ingress routes indicated by the Landing Track parameter, etc. The processors 304 may determine which route 202 need to be kept open and available to receive vehicle systems 100 from the vehicle yards 206 and/or terminals 204 using the information in all or some of the TTD, OPC, PVF, and Launch Track parameters. The processors 314 can generate a list, table, or other memory structure indicating which routes 202 need to be kept open at various times based on this information, when vehicle systems 100 will be leaving vehicle yards 206 and/or terminals 204, and the like. In one example, the processors 314 can constrain planned times of arrival for vehicle systems 100 at the various yards 206 and/or terminals 204, ingress routes for vehicle systems 100 to arrive at vehicle yards 206 and/or terminals, etc., according to either the EAT or PVF parameters and Landing Track parameter specified by the terminal operating system 302 for each vehicle system 100 that is approaching a vehicle yard 206 and/or terminal 204. The processors 314 may constrain planned times of departure and egress routes for vehicle systems 100 to leave a vehicle yard 206 and/or terminal 204 according to the either the TTD or PVF parameters and Launch Track parameter specified by the terminal operating system 302 for each vehicle system 100 that emerges from a vehicle yard 206 or terminal 204.

The terminal operating system 302 and the road dispatch system 304 include communication units 316, 318. The communication units 316, 318 represent hardware circuitry (e.g., transceiving circuitry, which can include one or more antennas, modems, or the like) that communicates with one or more other systems. For example, the communication unit 316 can communicate the EAT parameter, the Landing Track parameter, the TTD parameter, and/or the Launch Track parameter to the communication unit 318 of the road dispatch system 304. The communication unit 318 can communicate the PTA parameter and the EDT parameter to the communication unit 316 of the terminal operating system 302. The communication units 316, 318 can wirelessly communicate and/or communicate via one or more wired connections.

The communication units 316, 318 can communicate with other systems to implement the plans generated by the terminal operating system 302 and/or the road dispatch system 304. In one example, the communication unit 318 of the road dispatch system 304 can communicate with one or more movement planner systems 320. The movement planner systems 308 can include hardware circuitry that includes and/or is connected with one or more processors for determining schedules for vehicle systems 100 traveling in the transportation network 200. In one embodiment, several different movement planner systems 308 may automatically generate schedules for the vehicle systems 100 traveling in different areas of the transportation network 200, with different movement planner systems 308 generating the schedules for travel in the different areas. The movement planner systems 308 can automatically generate the schedules responsive to receiving information from the road dispatch system 304 that is based on the parameters received from the terminal operating system 302. This information can include, but is not limited to, which routes 202 need to be kept open at various times based on this information, when vehicle systems 100 will be leaving vehicle yards 206 and/or terminals 204, changes to the OPC parameter of vehicle system 100, and the like.

The communication unit 316 of the terminal operating system 302 can communicate with one or more yard planning systems 306. The yard planning systems 306 can include hardware circuitry that includes and/or is connected with one or more processors for determining plans for operations occurring within one or more vehicle yards 206 and/or terminals 204. These plans can dictate what operations are to occur on or with various vehicle systems 100 and/or vehicle units 102, 104, when the operations are to be performed, where the operations are to be performed, which resources are used to perform the operations, and the like. For example, a plan may direct an ingress route of a yard 206 to remain open to receive a first vehicle system 100 at noon, direct the vehicle system 100 to be separated into the vehicle units 102, 104 on identified routes within the yard 206, direct various maintenance, inspection, and/or repair operations to be performed on the vehicle units 102, 104, direct cargo to be loaded onto and/or unloaded from the vehicle units 104, direct different combinations of vehicle units 102, 104 to be combined into two or more other vehicle systems 100, and direct the newly formed vehicle systems 100 to depart the yard 206 at designated times on designated egress routes of the yard 206. The yard planning systems 306 may be associated with different yards 206 and/or terminals 204, and may generate the yard plans automatically in response to receiving information from the terminal operating system 302, such as the operations that can be performed on the vehicle systems 100 in the vehicle yards 206 and/or terminals 204, when the operations need to be completed, what resources are to be reserved for performing the operations, when vehicle systems 100 are permitted to leave the vehicle yards 206 and/or terminals 204, and the like.

In one example, the communication unit 316 of the terminal operating system 302 generates and sends a yard update message to the communication unit 318 of the road dispatch system 304. This message can include the EDT Parameter and Launch Track parameter for each (or at least one) vehicle system 100 departing or emerging from the vehicle yard 206. The communication unit 316 of the terminal operating system 302 can generate and send an earliest arrival time message to the communication unit 318 of the road dispatch system 304 for each vehicle system 100 approaching a vehicle yard 206 and/or terminal 204 as modified by any changes to the OPC parameters of any vehicle system 100. This message can include the EAT and/or the PVF parameter. The communication unit 316 of the terminal operating system 302 can generate and send a yard update message to the communication unit 318 of the road dispatch system 304 for each vehicle system 100 approaching a vehicle yard 206 and/or terminal 204. This message can include the EAT parameter and/or the Landing Track parameter.

The communication unit 318 of the road dispatch system 304 can generate and send the EDT parameter in a message for each vehicle system 100 emerging from a vehicle yard 206 and/or terminal 204 to the communication unit 316 of the terminal operating system 302. The communication unit 318 of the road dispatch system 304 can generate and send a planned arrival time message for each vehicle system 100 traveling toward a vehicle yard 206 and/or terminal 204 to the communication unit 316 of the terminal operating system 302. This message can include the PTA parameter.

Figure 5:
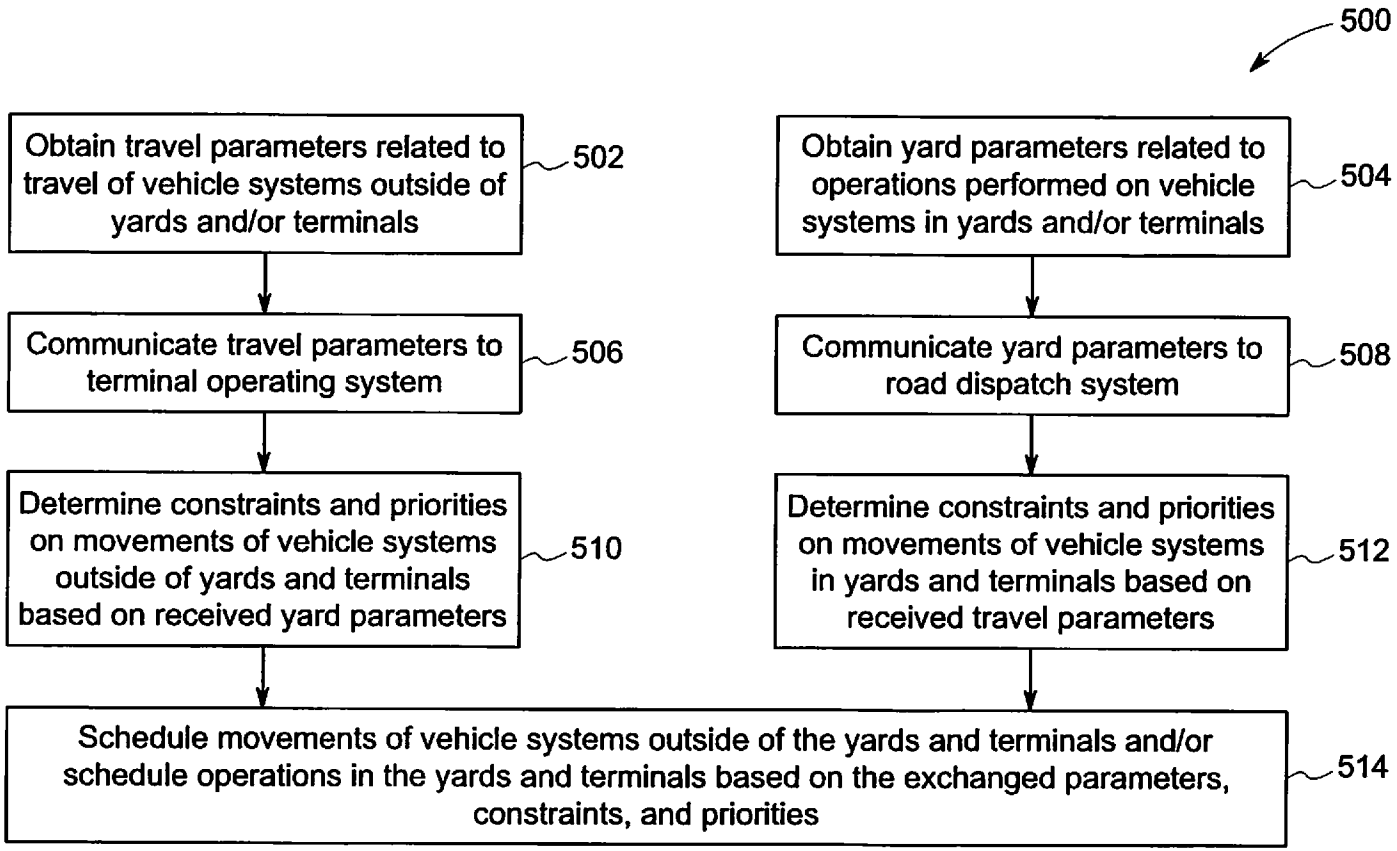
FIG. 5 illustrates a flowchart of one embodiment of a method for coordinating terminal operations with line of road movements.

FIG. 5 illustrates a flowchart of one embodiment of a method 500 for coordinating terminal operations with line of road movements. The method 500 may be performed by one or more embodiments of the system 100 shown in FIG. 1. At 502, travel parameters related to travel of vehicle systems outside of vehicle yards and/or terminals are obtained. These parameters can include the PTA parameter, OPC parameter and the EDT parameter. The parameters can be obtained from previously generated schedules of the vehicle systems, current locations and speeds of the vehicle systems, speed limits of the routes detection of changes to the OPC parameter, or the like.

At 504, yard parameters related to operations performed on vehicle systems in vehicle yards and/or terminals are obtained. These parameters can include the EAT parameter, the Landing Track parameter, the TTD parameter, the OPC parameter and/or the Launch Track parameter. These parameters can be obtained from previously generated plans for the yards and/or terminals, from user input, from automated yard systems such as hump yard controllers that directly measure elements of the OPC parameter or the like.

At 506, the travel parameters are communicated to a terminal operating system. At 506, the yard parameters are communicated to a road dispatch system. At 510, constraints on movements of the vehicle systems outside of the yards and terminals are determined based on the yard parameters that are received as well as any new or changed PVF parameters. At 512, constraints or priorities on operations on the vehicle systems in the yards and/or terminals are determined based on the travel parameters that are received. Two or more of the operations described in connection with 502, 504, 506, 508, 510, 512 may be performed sequentially, concurrently, or simultaneously. At 514, movements of the vehicle systems outside of the yards and terminals and operations in the yards and terminals are scheduled based on the exchanged parameters and the constraints determined from the parameters.

The scheduled movements and yard operations may be communicated to the vehicle systems and/or equipment in the vehicle yards and terminals in order to implement the movements and yard operations. For example, the scheduled movements may be communicated to the vehicle systems and the vehicle systems can automatically control speeds, throttles, brakes, or the like, so that the vehicle systems travel according to the scheduled movements. The scheduled yard operations can be communicated to equipment in the vehicle yards and/or terminals to cause the equipment to automatically and/or manually move within the yards and/or terminals for loading and/or unloading cargo, separating vehicle units from each other, forming vehicle systems, or the like.

One example of coordinating the planning activities for vehicle yards with the movement schedules for vehicles moving between the vehicle yards includes using the OPC and PVF parameters to determine which propulsion-generating vehicles are to be included in a vehicle system in order to ensure that the vehicle system can generate enough tractive effort or force to move the vehicle system from a starting location of a trip to a destination location of the trip (and/or one or more locations therebetween), while not including so many of the propulsion-generating vehicles that the vehicle system inefficiently operates during the trip. For example, including too few propulsion-generating vehicles or propulsion-generating vehicles generate too small amounts of tractive effort can result in the vehicle system arriving at a scheduled location at or before a scheduled time. On the other hand, including too many propulsion-generating vehicles or propulsion-generating vehicles that generate more tractive effort than is needed can result in the vehicle system consuming more fuel than is necessary in traveling along a route for the trip.

The terminal operating system and the dispatch system can communicate and coordinate activities with each other to ensure that the propulsion-generating vehicles that provide a sufficient amount of tractive effort to enable timely travel of the vehicle system while avoiding wasteful consumption of fuel are available and included in a vehicle system for a trip. This may also include using vehicle systems 100 to move propulsive vehicles 102 to another location even though the result is excess tractive effort, if the coordinated planning activities determine through the PVF parameter that it is worth the excess in order to support a vehicle system 100 at another location that has a high enough PVF parameter. The composite coordination system 300 can coordinate the planning operations of the terminal operating system 302 and the road dispatch system 304 by exchanging parameters and routes of vehicle systems 100 approaching terminals 204 and/or vehicle yards 206, and of vehicle systems 100 emerging from terminals 204 and/or vehicle yards 206.

One example of the parameters exchanged between the systems 302, 304 includes identities of which propulsion-generating vehicles 102 are available for inclusion in a vehicle system 100 within the various terminals 204 and/or vehicle yards 206. These identities can include road numbers, serial numbers, or other information that uniquely identifies individual vehicles 102 or types of vehicles 102 (e.g., with the same make and/or model of vehicles 102 being associated with the same identity). The terminal operating system 302 can provide this information to the road dispatch system 304. The identities of these vehicles 102 may be obtained from manual input, from electromagnetic scanners (e.g., radio frequency identification readers) that scan tags coupled with the vehicles 102 in the terminal 204 or yard 206, from a schedule of activities in the terminal 204 or yard 206 (e.g., where the availability is determined by examining the schedule of maintenance, inspection, or repair of a vehicle 102), etc. The input/output device 308 of the terminal operating system 302 can represent one or more of these devices that receive the information indicating the identities of the vehicles 102 that are available for inclusion in a vehicle system 100.

Another example of OPC parameter exchanged between the systems 302, 304 includes propulsive capabilities of propulsion-generating vehicles 102 within the various terminals 204 and/or vehicle yards 206. These capabilities can indicate upper limits or maximum amounts of propulsive forces, tractive efforts, and/or torques that the vehicles 102 can produce when the vehicles 102 are moving along a route. The propulsive capabilities can be associated with the identities of the vehicles 102 such that, when the identities of the vehicles 102 in a terminal 204 or yard 206 are obtained, the propulsive capabilities of the vehicles 102 also are obtained or such that the propulsive capability of a vehicle 102 may be obtained based on the identity of the vehicle 102.

Another example of the parameters exchanged between the systems 302, 304 includes upcoming or future availabilities of the vehicles 102. These availabilities can include the dates and/or times at which various vehicles 102 can be included in a vehicle system 100 departing from a terminal 204 or yard 206. The availability of a vehicle 102 may be represented by the scheduled date and/or time at which the vehicle 102 is scheduled to arrive at a terminal 204 and/or vehicle yard 206 from one or more locations outside of the terminal 204 or vehicle yard 206. The availability optionally can include the date and/or time at which the vehicle 102 is scheduled to have maintenance, inspection, and/or repair completed.

Another example of the OPC parameter is load information. The load information represents the amount, weight, and/or type of cargo being carried in the vehicle system 100 that will include the vehicles 102. For example, the load information can indicate a volume, mass, weight, or number of cargo being carried by the vehicle system 100. Another example of the OPC parameter pertains to route information. The route information can represent the curvature and/or grade of the route over which the vehicle system 100 being built to include the vehicles 102 will travel. Optionally, the route information can indicate the geographic locations and layouts of routes, switches at intersections of the routes, or other information.

The system 300 coordinates communications between the terminal operating system 302 and the road dispatch system 304 to provide for planning across the boundaries of the systems 302, 304 and to provide for more efficient operations and movements of the vehicle systems 100 compared to either the terminal operating system 302 or the road dispatch system 304 operating alone (e.g., without receiving the parameters communicated from the other system 302 or 304). For example, based on the parameters that are shared between the systems 302, 304, the system 300 can determine which vehicles 102 to include in a vehicle system 100 that is being built in and/or departing from one or more of the terminals 204 or yards 206.

One or more of the processors 312, 314 of the system 300 can receive the parameters described herein and determine which vehicles 102 to include in a vehicle system 100 scheduled for departure from a terminal 204 or yard 206. For example, the processors 312 of the terminal operating system 302 can examine the identities of vehicles 102 that are available for inclusion in a vehicle system 100 being formed within a terminal 204 or yard 206 and/or the propulsive capabilities of the vehicles 102 that are available and/or scheduled to be available in the terminal 204 or yard 206 to determine which vehicles 102 can be included in the vehicle system 100. The processors 312 can obtain this information from the devices 308. The processors 312 can receive the dates and/or times at which one or more other vehicles 102 are scheduled to arrive at the terminal 204 or yard 206, the identities of these vehicles 102, and/or the propulsive capabilities of these vehicles 102 from the processors 314 of the road dispatch system 304 (e.g., via the communication unit 318). From this information, the processors 312 can determine which vehicles 102 will be available for inclusion in the vehicle system 100, when these vehicles 102 will be available, and the propulsive capabilities of the vehicles 102.

The processors 312 can obtain the route information from the planning processors 314 of the road dispatch system 304 (e.g., via the communication unit 318). Based on the identities, availabilities, propulsive capabilities, the load information, and/or the route information, the processors 312 of the terminal operating system 302 can select a set of the vehicles 102 for inclusion in a vehicle system 100. As one example, the processors 312 can determine how much propulsive force or tractive effort will be needed at one or more locations along a route of an upcoming trip of the vehicle system 100. The propulsive force or tractive effort that is determined may be based on the route information and the load information. For heavier cargo loads and/or sections of the route having steeper inclines, the amount of propulsive force or tractive effort needed to propel the vehicle system 100 will be larger relative to lighter cargo loads and/or sections of the route having flat or downhill grades. The processors 312 can base this determination on previous trips of other vehicle systems 100, on physics based models of movements of the cargo and vehicles 104 along the route, or based on input provided by one or more operators of the system 300.

Once the propulsive forces or tractive efforts are determined, the processors 312 can examine which vehicles 102 are available, when these vehicles 102 are available, and the propulsive capabilities of the vehicles 102 to select one or more of the vehicles 102 for inclusion in the vehicle system 100. For example, the processors 312 may determine that 16,000 horsepower is needed to propel the cargo carried by the vehicle system 100 through one section of the route, while only 3,000 horsepower is needed for another, different section of the route. The processors 312 can then examine when the vehicle system 100 is scheduled to depart from the terminal 204 or yard 206, and use this departure time to determine which vehicles 102 will be available in the terminal 204 or yard 206 prior to the departure time (and with enough time to add the vehicles 102 to the vehicle system 100). The processors 312 can examine the propulsive capabilities of these available vehicles 102 to determine which vehicles 102 and how many of the vehicles 102 are to be included in the vehicle system 100. For example, the following vehicles 102 and the associated propulsive capabilities may be available for inclusion in the vehicle system 100 prior to a scheduled departure of the vehicle system 100:

| Vehicle | Horsepower |
|---|---|
| First | 4,400 |
| Second | 4,000 |
| Third | 2,000 |
| Fourth | 4,200 |
| Fifth | 3,000 |
| Sixth | 2,400 |
| Seventh | 3,200 |
| Eighth | 4,400 |
| Ninth | 4,000 |

The processors 312 can examine different combinations of some, but not all, of the available vehicles 102 to determine which combinations of the vehicles 102 have a combined propulsive capability that meets or exceeds the propulsive force or tractive effort needed for the trip. For example, the processors 312 can compare the combined propulsive capabilities of the different combinations of vehicles 102 to determine which combined propulsive capabilities are at least as large as the largest propulsive force or tractive effort needed to complete the trip. If one section of the trip requires at least 14,000 horsepower, for example, the processors 312 can determine that a first combination of the first, third, fourth, and eighth vehicles 102, a second combination of the first, second, third, and fourth vehicles 102, a third combination of the first, third, fifth, sixth, and seventh vehicles 102, a fourth combination of the third, fifth, sixth, seventh, and ninth vehicles 102, and a fifth combination of the fourth, fifth, sixth, and eighth vehicles 102 all have combined propulsive capabilities that meet or exceed the 14,000 horsepower requirement of the trip.

The processors 312 can then select one of these combinations of the vehicles 102 to include in the vehicle system 100. For example, the processors 312 may select the combination having the smallest number of vehicles 102, the combination having the vehicles 102 that weigh less than the vehicles 102 of the other combinations, the combination having the vehicles 102 that are scheduled for arrival at or departure from another terminal 204 or yard 206 along the route being traveled for the trip, or another combination of the vehicles 102. The selected combination of the vehicles 102 may then be communicated to one or more devices or equipment in the terminal 204 or yard 206 that operate to build the vehicle system 100. For example, the selected combination may be communicated to a switch between routes within the terminal or yard to cause the switch to change position and cause a vehicle 102 in the selected combination to move to a route where the vehicle system 100 is being built. As another example, the selected combination may be communicated to equipment or personnel that are inspecting or repairing the vehicle(s) 102 in the combination so that the equipment or personnel can ensure that the inspection or repair is completed in time to include the vehicle(s) 102 in the vehicle system 100.

In one embodiment, the processors 312 of the terminal operating system 302 can communicate a signal to the processors 314 of the road dispatch system 304 to request a change in the state of one or more components of a route to change an availability of one or more of the vehicles 102. The processors 312 may determine that a vehicle 102 will arrive too late to be included in a vehicle system 100 scheduled for departure or that the vehicle 102 is scheduled to travel to another terminal 204 or yard 206, but that the vehicle 102 otherwise could be included in the vehicle system 100. The processors 312 can change the arrival time of the vehicle 102 or change where the vehicle 102 is traveling toward in order to make the vehicle 102 available for inclusion in the vehicle system 100.

The processors 312 can communicate a signal to the processors 314 of the road dispatch system 304 (e.g., via the communication units 316, 318) to request that the state or position of a switch at an intersection of two or more routes be changed. The state or position of the switch can be changed in order to change which route the vehicle 102 or a vehicle system 100 that includes the vehicle 102 will travel upon subsequent to passing through or over the switch. Optionally, the processors 312 can communicate a signal to the processors 314 of the road dispatch system 304 to request that the state or position of a gate or signal be changed. The state or position of the gate or signal can be changed in order to change when the vehicle 102 or a vehicle system 100 that includes the vehicle 102 will arrive at a terminal 204 or yard 206.

Changing the state or position of the switch, gate, or signal can cause the vehicle 102 to arrive at a different terminal 204 or yard 206 and/or to arrive at the terminal 204 or yard 206 at a different time (e.g., by avoiding sitting on a siding section of rail, by avoiding traveling to another terminal 204 or yard 206, etc.). As a result, the availability of the vehicle 102 to be included in a vehicle system 100 can be controlled or changed by the terminal operating system 302. Upon receipt of the request from the processors 312 of the terminal operating system 302, the processors 314 of the road dispatch system 304 can examine the schedule of the vehicle 102 requested by the processors 312 of the terminal operating system 302 to determine whether the state or position of the switch, gate, or signal can be changed while avoiding significant disruptions of the schedules of other vehicle systems 100. If the state or position of the switch, gate, or signal can be changed while avoiding significant disruptions of the schedules of other vehicle systems 100, then the processors 314 can communicate a signal to the switch, gate, or signal that instructs and causes the switch, gate, or signal to automatically change state or position. Otherwise, the processors 314 may communicate a signal to the processors 312 to inform the processors 312 that the state or position of the gate, switch, or signal cannot be changed.

Figure 6:
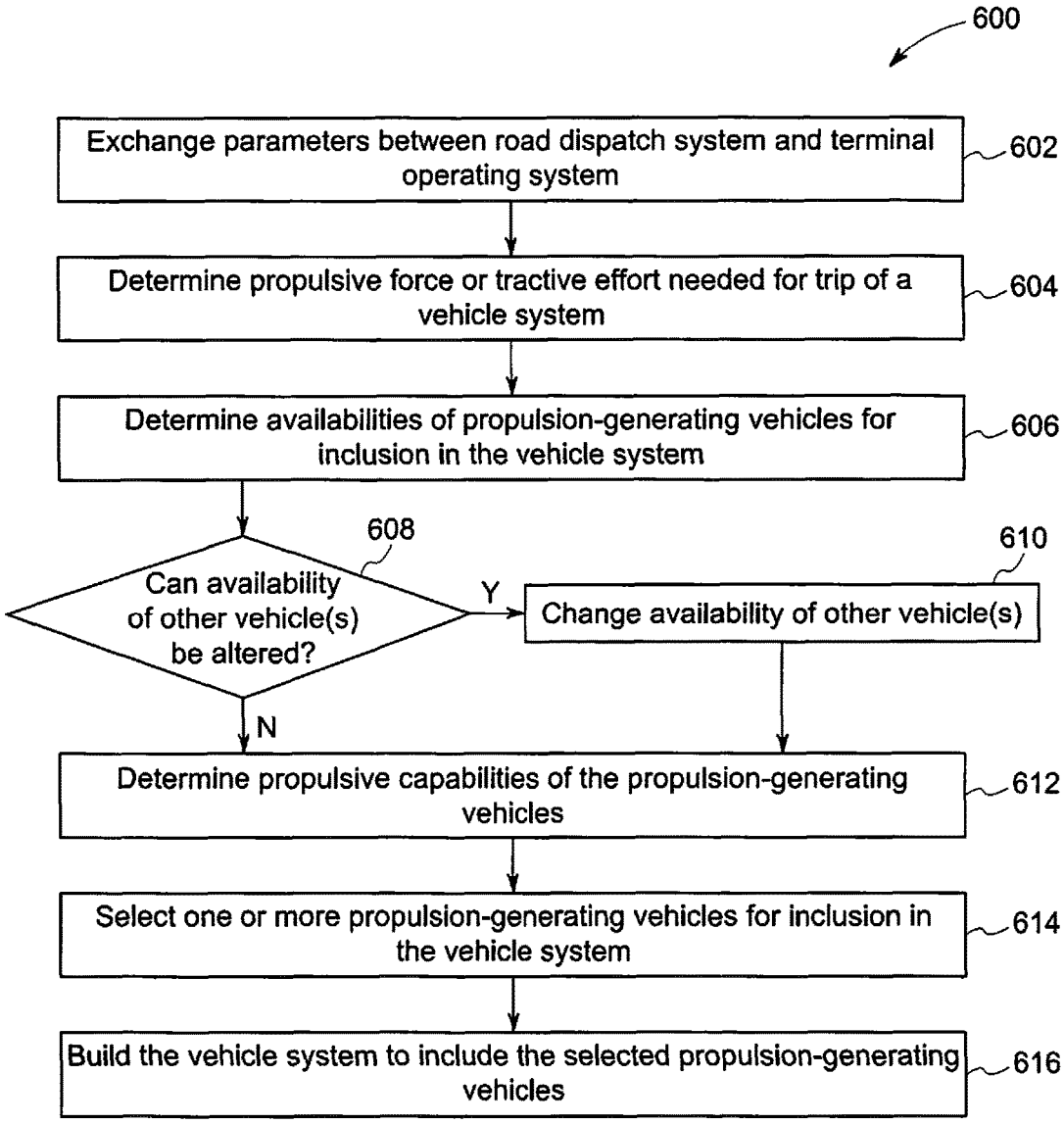
FIG. 6 illustrates a flowchart of one embodiment of a method for building a vehicle system.

FIG. 6 illustrates a flowchart of one embodiment of a method 600 for building a vehicle system 100. The method 600 may be used to identify how much tractive effort or propulsive force is needed to propel the vehicle system 100 for a trip, to determine which propulsion-generating vehicles 102 are available for inclusion in the vehicle system 100, for determining which vehicles 102 to include in the vehicle system 100, and optionally to communicate signals that cause the vehicle system 100 to be built and/or to change the availability of one or more of the vehicles 102. In one embodiment, the method 600 can represent an algorithm that is performed by the system 300 in order to build a vehicle system 100 and/or to change movement of one or more vehicles 102 in order to enable or assist in the building of the vehicle system 100. The flowchart can represent or be used to create a software program that directs operations of one or more of the components of the system 300 shown in FIG. 3. While the flowchart illustrates one temporal order of the operations of the method 600, alternatively, two or more of these operations may be performed in another order.

At 602, parameters are exchanged between the road dispatch system and the terminal operating system. As described above, parameters such as route information, load information, identities of propulsion-generating vehicles, availabilities or scheduled availabilities of the propulsion-generating vehicles, propulsive capabilities of the propulsion-generating vehicles, or other information may be communicated to the terminal operating system. At 604, propulsive forces or tractive efforts needed to complete travel of cargo during a trip of the vehicle system being built are determined. These forces or efforts may be calculated based on the parameters that are exchanged (as described above), and can represent the forces or efforts needed to propel the cargo and vehicles of the vehicle system along uphill grades, downhill grades, along curves, along straight sections of the route, etc.

At 606, availabilities of the propulsion-generating vehicles that may be included in the vehicle system are determined. These availabilities may be determined by examining the schedules of the vehicles, the current states of maintenance, repair, and/or inspection of the vehicles, and/or the current locations of the vehicles. At 608, a determination can be made as to whether the availability of one or more of the propulsion-generating vehicles can be altered. For example, one or more vehicles may not be available for inclusion in the vehicle system being built due to schedules of the vehicles keeping the vehicles occupied or outside of the terminal or yard where the vehicle system is being built until after the vehicle system is scheduled for departure. A determination may be made as to whether the schedule of one or more of these vehicles (or vehicle systems that include the vehicles) can be changed, the route being traveled by the vehicles can be changed, or the maintenance, inspection, or repair of the vehicles can be changed in order to make the vehicle available for inclusion in the vehicle system being built.

This determination may be made by examining current locations, schedules, and/or states of the vehicles and determining whether the location, schedule, or state of a vehicle can be altered. In one embodiment, the location, schedule, or state of a vehicle can be altered when doing so does not interfere with or block the movement of other vehicles or vehicle systems, does not worsen traffic congestion one or more routes, and/or does not delay other vehicles or vehicle systems. Optionally, the location, schedule, or state of a vehicle can be altered when there are sufficient paths (e.g., routes) between the vehicle and the terminal or yard where the vehicle system is being built to move the vehicle to the terminal or yard.

If the availability of one or more of the propulsion-generating vehicles can be changed, then flow of the method 600 can proceed toward 610. If, on the other hand, the availability of the propulsion-generating vehicle(s) cannot be changed, then flow of the method 600 can proceed toward 612. At 610, the availability of the one or more propulsion-generating vehicles is changed. This may occur by communicating a signal to a switch at an intersection between routes that causes the switch to change states or positions (and thereby control or change which route the vehicle travels on), to a signal that causes the signal to change indications (e.g., from a green to red light), to a gate that causes the gate to change positions (e.g., from a blocking position that prevents passage of a vehicle to an open position that allows the vehicle to pass), or to an operator to direct the operator to change movement or operation of the vehicle.

At 612, the propulsive capabilities of the propulsion-generating vehicles that are available or that will be available are determined. The propulsive capabilities of the vehicles can be stored in a memory (e.g., a computer hard drive, random access memory, read only memory, optical disk, etc.) that is accessible by the processors 312 and/or communicated to the processors 312 so the processors 312 can examine the propulsive capabilities. At 614, one or more of the propulsion-generating vehicles are selected for inclusion in the vehicle system based on the propulsive capabilities as well as the assessment of the PVF parameter for the vehicle system. For example, of the vehicles that are available or that will be available for inclusion in the vehicle system prior to a scheduled or actual departure of the vehicle system from the terminal or yard, the propulsive capabilities of these vehicles can be examined in order to determine which combination or combinations of the vehicles provide at least the amount of propulsive force or tractive effort that is needed to complete the upcoming trip of the vehicle system. The propulsive vehicles that are selected may the minimum number of vehicles that provide at least the propulsive force or tractive effort needed for the trip, the vehicles that consume less fuel than one or more (or all) other combinations of the vehicles, the vehicles that are available for an earlier departure than one or more (or all) other combinations of the vehicles, the most valuable use of the propulsive vehicle etc.

At 616, the vehicle system is built to include the propulsion-generating vehicles that are selected. The vehicle system may be built by generating signals communicated to equipment that moves the vehicles to the proper location within the terminal or yard for placing the vehicles in the vehicle system, such as switches, gates, etc. This equipment may then automatically operate to move the vehicles to the locations needed for building the vehicle system. Optionally, the signals may be communicated to the road dispatch system so that the road dispatch system can alter the schedule of the vehicles or vehicle systems that include the vehicles and cause the vehicles to arrive at the terminal or yard where the vehicle system is being built.

In one embodiment, a composite system includes a road dispatch system and a terminal operating system that coordinate vehicle operations across a planning boundary between the road dispatch system and the terminal operating system to provide more efficient operation than either the road dispatch system or the terminal operating system functioning alone.

In one example, the road dispatch system is responsible for safe and efficient conveyance of railroad trains across a network of terminals, switching yards, and industry.

In one example, the terminal operating system is responsible for safe and efficient switching of railcars received and delivered to and from industry, and to and from line-of-road.

In one example, operation of the road dispatch system is augmented by an automated movement planner.

In one example, the automated movement planner accepts input constraints specifying target departure times and egress routes of trains emerging from a yard and/or terminal.

In one example, the automated movement planner accepts input constraints specifying earliest arrival times and ingress routes of trains approaching a terminal and/or yard.

In one example, operation of the terminal operating system is augmented by an automated yard planner.

In one example, the terminal operating system accepts input constraints specifying planned arrival times of approaching trains and earliest departure times of emerging trains.

In one example, the terminal operating system determines earliest arrival times and ingress routes of approaching trains.

In one example, the ingress routes are determined by a receiving track on which the train will be yarded, a route over which the train will travel from a previous intermediate or point-of-origin terminal or switching facility, and planned train, car, maintenance of way, or inspection activities on intervening and adjacent tracks.

In one example, the terminal operating system determines target time of departure and egress route for emerging trains.

In one example, the egress route is determined by the forwarding track in which the train will be built, the route over which the train will travel to a next intermediate or final destination, and planned train, car, maintenance of way, or inspection activities on intervening and adjacent tracks.

In one example, the road dispatch system determines planned time of arrival of approaching trains and earliest departure times for emerging trains.

In one example, an earliest arrival time is determined by an availability of resources necessary to process an approaching train, including receiving track, yard crew and yard locomotives, road crew and road power for the outbound train that will carry the cars from the approaching train.

In one example, a target time of departure is determined by a movement plan, a planned completion of train building operations, and an availability of resources necessary to build an outbound train, including forwarding track, yard crew and yard locomotives, road crew and road power for the outbound train.

In one example, the terminal operating system produces and sends a yard update message to the road dispatch system, the yard update message including a target departure time and launch track point of egress for each emerging train.

In one example, the terminal operating system produces and sends to the road dispatch system an earliest arrival time message and a yard update message having an earliest arrival time and landing track for each approaching train.

In one example, the road dispatch system produces and sends to the terminal operating system an earliest departure time message for each emerging train and a planned arrival time message for each approaching train.

In one example, the road dispatch system constrains planned time of arrival and ingress route according to the earliest time of arrival and landing track for specified by the terminal operating system for each approaching train.

In one example, the road dispatch system constrains planned time of departure and egress route according to the target time of departure and launch track specified by the terminal operating system for each approaching train.

In one example, the terminal operating system plans train arrivals and departures so as to comply with a planned time of arrival and earliest departure time specified by the road dispatch system for each emerging train.

In one embodiment, a method (e.g., for coordinating terminal operations with line of road movements) includes obtaining (at a road dispatch system that schedules movements of vehicle systems in a transportation network) travel parameters related to the movements of vehicle systems on routes that are outside of vehicle yards and terminals in the transportation network, obtaining (at a terminal operating system that plans yard operations within vehicle yards and terminals) yard parameters related to the yard operations performed in the vehicle yards and terminals, communicating the travel parameters from the road dispatch system to the terminal operating system, communicating the yard parameters from the terminal operating system to the road dispatch system, and scheduling network operations within the transportation network based on the travel parameters and the yard parameters. The network operations that are scheduled including the movements of the vehicle systems on the routes outside of the vehicle yards and the terminals based on the yard parameters and the yard operations to be performed on the vehicle systems in the vehicle yards and the terminals.

In one example, the travel parameters include one or more of a planned time of arrival parameter at which one or more of the vehicle systems are scheduled to arrive at one or more of the vehicle yards or terminals, or an earliest departure time parameter representing a time at which one or more of the routes connected with one or more of the vehicle yards or terminals has space to receive one or more of the vehicle systems in the one or more of the vehicle yards or terminals.

In one example, the yard parameters include one or more of an earliest arrival time parameter representing a time at which one or more of the vehicle yards or terminals has capacity to receive one or more of the vehicle systems from one or more of the routes, a landing track parameter representing a first route of the routes that one or more of the vehicle systems is to travel on during an approach to one or more of the vehicle yards or terminals, a target time of departure parameter representing a time at which one or more of the vehicle systems is scheduled to depart from one or more of the vehicle yards or terminals and enter onto one or more of the routes that are outside of the vehicle yards or terminals, or a launch track parameter representing a second route of the routes that one or more of the vehicle systems is scheduled to travel onto after departing from one or more of the vehicle yards or terminals.

In one embodiment, a system (e.g., a composite system for coordinating terminal operations with line of road movements) includes one or more first processors configured to obtain (at a road dispatch system that schedules movements of vehicle systems in a transportation network) travel parameters related to the movements of vehicle systems on routes that are outside of vehicle yards and terminals in the transportation network, one or more second processors configured to obtain (at a terminal operating system that plans yard operations within vehicle yards and terminals) yard parameters related to the yard operations performed in the vehicle yards and terminals, a first communication unit configured to communicate the travel parameters from the road dispatch system to the terminal operating system, and a second communication unit configured to communicate the yard parameters from the terminal operating system to the road dispatch system. The one or more first processors are configured to schedule the movements of the vehicle systems on the routes outside of the vehicle yards and the terminals based on the yard parameters and the one or more second processors are configured to schedule the yard operations to be performed on the vehicle systems in the vehicle yards and the terminals based on the travel parameters.

In one example, the travel parameters include one or more of a planned time of arrival parameter at which one or more of the vehicle systems are scheduled to arrive at one or more of the vehicle yards or terminals, or an earliest departure time parameter representing a time at which one or more of the routes connected with one or more of the vehicle yards or terminals has space to receive one or more of the vehicle systems in the one or more of the vehicle yards or terminals.

In one example, the yard parameters include one or more of an earliest arrival time parameter representing a time at which one or more of the vehicle yards or terminals has capacity to receive one or more of the vehicle systems from one or more of the routes, a landing track parameter representing a first route of the routes that one or more of the vehicle systems is to travel on during an approach to one or more of the vehicle yards or terminals, a target time of departure parameter representing a time at which one or more of the vehicle systems is scheduled to depart from one or more of the vehicle yards or terminals and enter onto one or more of the routes that are outside of the vehicle yards or terminals, or a launch track parameter representing a second route of the routes that one or more of the vehicle systems is scheduled to travel onto after departing from one or more of the vehicle yards or terminals.

In one embodiment, a terminal operating system includes one or more processors configured to obtain one or more parameters of non-propulsion-generating cargo vehicles and to determine which of the non-propulsion-generating cargo vehicles are to be included in a vehicle system assembled in a terminal or yard based on the one or more parameters. The one or more parameters include one or more of an earliest time of availability at which cargo equipment will be available in the terminal or yard, a safety operational characteristic, an efficiency operational characteristic of the one or more non-propulsion-generating cargo vehicles, and/or a priority parameter of the one or more non-propulsion-generating cargo vehicles. The one or more processors are configured to automatically direct equipment within the terminal or yard to assemble the vehicle system based on the one or more parameters.

In one example, the one or more processors are configured to receive, from a road dispatch system, one or more of route grades or curvatures, and the one or more processors are configured to determine an amount of propulsive force needed for the vehicle system to complete travel of a trip along a route that includes the one or more route grades or curvatures.

In one example, the one or more processors are configured to determine which propulsion-generating vehicles to include in the vehicle system based on the amount of propulsive force that is determined.

In one example, the one or more processors are configured to determine which of the propulsion-generating vehicles to include in the vehicle system based on which of the propulsion-generating vehicles are available or will be available for inclusion in the vehicle system prior to a scheduled departure of the vehicle system.

In one example, the earliest time of availability at which cargo equipment will be available in the terminal or yard indicates when the cargo equipment will be available for one or more of loading cargo onto or unloading cargo from the one or more non-propulsion-generating cargo vehicles.

In one example, the safety operational characteristic restricts how closely a lighter non-propulsion-generating cargo vehicle can be located to a heavier non-propulsion-generating cargo vehicle within the vehicle system.

In one example, the safety operational characteristic restricts how closely one or more of the non-propulsion-generating cargo vehicles can be located to a propulsion-generating vehicle within the vehicle system.

In one example, the safety operational characteristic restricts whether the propulsion-generating vehicles can be disposed close to each other in the vehicle system or are to be distributed throughout a length of the vehicle system.

In one example, the efficiency operational characteristic of the one or more propulsion-generating cargo vehicles requires two or more of the non-propulsion-generating cargo vehicles having double stacked containers to be disposed next to each other in the vehicle system.

In one embodiment, a method includes obtaining, at a terminal operating system of a terminal or yard, one or more parameters of non-propulsion-generating cargo vehicles, and selecting the non-propulsion-generating cargo vehicles that are to be included in a vehicle system assembled in the terminal or yard based on the one or more parameters. The one or more parameters include one or more of an earliest time of availability at which cargo equipment will be available in the terminal or yard, a safety operational characteristic, an efficiency operational characteristic of the one or more non-propulsion-generating cargo vehicles, and/or a priority parameter of the one or more non-propulsion-generating cargo vehicles. The method also includes assembling the vehicle system with the non-propulsion-generating cargo vehicles that are selected for inclusion in the vehicle system.

In one example, the method also includes receiving, at the terminal operating system from a road dispatch system, one or more of route grades or curvatures, and determining an amount of propulsive force needed for the vehicle system to complete travel of a trip along a route that includes the one or more route grades or curvatures.

In one example, determining which propulsion-generating vehicles to include in the vehicle system is based on the amount of propulsive force that is determined.

In one example, determining which of the propulsion-generating vehicles to include in the vehicle system is based on which of the propulsion-generating vehicles are available or will be available for inclusion in the vehicle system prior to a scheduled departure of the vehicle system.

In one example, the earliest time of availability at which cargo equipment will be available in the terminal or yard indicates when the cargo equipment will be available for one or more of loading cargo onto or unloading cargo from the one or more non-propulsion-generating cargo vehicles.

In one example, the safety operational characteristic restricts how closely a lighter non-propulsion-generating cargo vehicle can be located to a heavier non-propulsion-generating cargo vehicle within the vehicle system.

In one example, the safety operational characteristic restricts how closely one or more of the non-propulsion-generating cargo vehicles can be located to a propulsion-generating vehicle within the vehicle system.

In one example, the safety operational characteristic restricts whether the propulsion-generating vehicles can be disposed close to each other in the vehicle system or are to be distributed throughout a length of the vehicle system.

In one example, the efficiency operational characteristic of the one or more propulsion-generating cargo vehicles requires two or more of the non-propulsion-generating cargo vehicles having double stacked containers to be disposed next to each other in the vehicle system.

In one embodiment, a system includes one or more first processors configured to obtain, at a road dispatch system that schedules movements of vehicle systems in a transportation network, travel parameters related to the movements of vehicle systems on routes that are outside of vehicle yards and terminals in the transportation network. The system also includes one or more second processors configured to obtain, at a terminal operating system that plans yard operations within vehicle yards and terminals, yard parameters related to the yard operations performed in the vehicle yards and terminals. The system also includes a first communication unit configured to communicate the travel parameters from the road dispatch system to the terminal operating system and a second communication unit configured to communicate the yard parameters from the terminal operating system to the road dispatch system. The one or more first processors are configured to schedule the movements of the vehicle systems on the routes outside of the vehicle yards and the terminals based on the yard parameters and the one or more second processors are configured to schedule the yard operations to be performed on the vehicle systems in the vehicle yards and the terminals based on the travel parameters.

In one example, the one or more first processors and the one or more second processors are configured to communicate parameters between the road dispatch system and the terminal operating system to determine which propulsion-generating vehicles to include in at least one of the vehicle systems being built in one or more of the terminals or vehicle yards. The one or more first processors also are configured to communicate one or more of route grades or curvatures to the one or more second processors. The one or more second processors also are configured to determine an amount of propulsive force needed for the at least one of the vehicle systems to complete travel of a trip along a route that includes the one or more route grades or curvatures.

In one example, the one or more first processors are configured to change an availability of at least one of the propulsion-generating vehicles for inclusion in the at least one of the vehicle systems by changing one or more of a state or a position of one or more of a switch, a signal, and/or a gate.

It is to be understood that the above description is intended to be illustrative, and not restrictive. For example, the above-described embodiments (and/or examples thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A terminal operating system comprising:

one or more processors configured to obtain one or more parameters of non-propulsion-generating cargo vehicles and to determine which of the non-propulsion-generating cargo vehicles are to be included in a vehicle system assembled in a terminal or yard based on the one or more parameters, wherein the one or more parameters include one or more of an earliest time of availability at which cargo equipment will be available in the terminal or yard or an efficiency operational characteristic of the one or more non-propulsion-generating cargo vehicles, wherein the one or more processors are configured to automatically direct equipment within the terminal or yard to assemble the vehicle system based on the one or more parameters.

2. The terminal operating system of claim 1, wherein the one or more processors are configured to receive, from a road dispatch system, one or more of route grades or curvatures, and the one or more processors are configured to determine an amount of propulsive force needed for the vehicle system to complete travel of a trip along a route that includes the one or more route grades or curvatures.

3. The terminal operating system of claim 2, wherein the one or more processors are configured to determine which propulsion-generating vehicles to include in the vehicle system based on the amount of propulsive force that is determined.

4. The terminal operating system of claim 3, wherein the one or more processors are configured to determine which of the propulsion-generating vehicles to include in the vehicle system based on which of the propulsion-generating vehicles are available or will be available for inclusion in the vehicle system prior to a scheduled departure of the vehicle system.

5. The terminal operating system of claim 1, wherein the earliest time of availability at which cargo equipment will be available in the terminal or yard indicates when the cargo equipment will be available for one or more of loading cargo onto or unloading cargo from the one or more non-propulsion-generating cargo vehicles.

6. The terminal operating system of claim 1, wherein the one or more processors also are configured to determine which of the non-propulsion-generating cargo vehicles are to be included in the vehicle system based on a restriction on how closely a lighter non-propulsion-generating cargo vehicle can be located to a heavier non-propulsion-generating cargo vehicle within the vehicle system.

7. The terminal operating system of claim 1, wherein the one or more processors also are configured to determine which of the non-propulsion-generating cargo vehicles are to be included in the vehicle system based on a restriction on how closely one or more of the non-propulsion-generating cargo vehicles can be located to a propulsion-generating vehicle within the vehicle system.

8. The terminal operating system of claim 1, wherein the one or more processors also are configured to determine which of the non-propulsion-generating cargo vehicles are to be included in the vehicle system based on a requirement that the propulsion-generating vehicles be distributed throughout a length of the vehicle system.

9. The terminal operating system of claim 1, wherein the one or more processors also are configured to determine which of the non-propulsion-generating cargo vehicles are to be included in the vehicle system based on a requirement that two or more of the non-propulsion-generating cargo vehicles having double stacked containers be disposed next to each other in the vehicle system.

10. The system of claim 1, wherein the one or more parameters include the earliest time of availability at which cargo equipment will be available in the terminal or yard, a safety operational characteristic, the efficiency operational characteristic of the one or more non-propulsion-generating cargo vehicles, and a priority parameter of the one or more non-propulsion-generating cargo vehicles.

11. A method comprising:

obtaining, at a terminal operating system of a terminal or yard, one or more parameters of non-propulsion-generating cargo vehicles;

selecting the non-propulsion-generating cargo vehicles that are to be included in a vehicle system assembled in the terminal or yard based on the one or more parameters, wherein the one or more parameters include one or more of an earliest time of availability at which cargo equipment will be available in the terminal or yard or an efficiency operational characteristic of the one or more non-propulsion-generating cargo vehicles; and assembling the vehicle system with the non-propulsion-generating cargo vehicles that are selected for inclusion in the vehicle system.

12. The method of claim 11, further comprising:

receiving, at the terminal operating system from a road dispatch system, one or more of route grades or curvatures; and determining an amount of propulsive force needed for the vehicle system to complete travel of a trip along a route that includes the one or more route grades or curvatures.

13. The method of claim 12, wherein determining which propulsion-generating vehicles to include in the vehicle system is based on the amount of propulsive force that is determined.

14. The method of claim 13, wherein determining which of the propulsion-generating vehicles to include in the vehicle system is based on which of the propulsion-generating vehicles are available or will be available for inclusion in the vehicle system prior to a scheduled departure of the vehicle system.

15. The method of claim 11, wherein the earliest time of availability at which cargo equipment will be available in the terminal or yard indicates when the cargo equipment will be available for one or more of loading cargo onto or unloading cargo from the one or more non-propulsion-generating cargo vehicles.

16. The method of claim 11, wherein selecting the non-propulsion-generating cargo vehicles that are to be included in the vehicle system also is based on a restriction on how closely a lighter non-propulsion-generating cargo vehicle can be located to a heavier non-propulsion-generating cargo vehicle within the vehicle system.

17. The method of claim 11, wherein selecting the non-propulsion-generating cargo vehicles that are to be included in the vehicle system also is based on a restriction on how closely one or more of the non-propulsion-generating cargo vehicles can be located to a propulsion-generating vehicle within the vehicle system.

18. The method of claim 11, wherein selecting the non-propulsion-generating cargo vehicles that are to be included in the vehicle system also is based on a requirement that the propulsion-generating vehicles be distributed throughout a length of the vehicle system.

19. The method of claim 11, wherein selecting the non-propulsion-generating cargo vehicles that are to be included in the vehicle system also is based on a requirement that two or more of the non-propulsion-generating cargo vehicles having double stacked containers be disposed next to each other in the vehicle system.

20. A system comprising:

one or more first processors configured to obtain, at a road dispatch system that schedules movements of vehicle systems on routes that are outside of vehicle yards and terminals in a transportation network, travel parameters related to the movements of vehicle systems on the routes that are outside of the vehicle yards and terminals in the transportation network;

one or more second processors configured to obtain, at a terminal operating system that plans yard operations within the vehicle yards and terminals, yard parameters related to the yard operations performed in the vehicle yards and terminals;

a first communication unit configured to communicate the travel parameters from the road dispatch system to the terminal operating system; and a second communication unit configured to communicate the yard parameters from the terminal operating system to the road dispatch system;

wherein the one or more first processors are configured to schedule the movements of the vehicle systems on the routes outside of the vehicle yards and the terminals based on the yard parameters and the one or more second processors are configured to schedule the yard operations to be performed on the vehicle systems in the vehicle yards and the terminals based on the travel parameters, wherein the one or more first processors are configured to change an availability of at least one of the propulsion-generating vehicles for inclusion in the at least one of the vehicle systems by changing one or more of a state or a position of one or more of a switch, a signal, or a gate.

21. The system of claim 20, wherein the one or more first processors and the one or more second processors are configured to communicate parameters between the road dispatch system and the terminal operating system to determine which propulsion-generating vehicles to include in at least one of the vehicle systems being built in one or more of the terminals or vehicle yards, the one or more first processors configured to communicate one or more of route grades or curvatures to the one or more second processors, the one or more second processors also configured to determine an amount of propulsive force needed for the at least one of the vehicle systems to complete travel of a trip along a route that includes the one or more route grades or curvatures.

* * * * *